US007883484B1

(12) United States Patent
Wu

(10) Patent No.: US 7,883,484 B1
(45) Date of Patent: Feb. 8, 2011

(54) BELT EXERCISING AND MASSAGING DEVICE

(76) Inventor: Dong-Her Wu, 141, Sec. 2, Chang Shui Rd., Pu Yen Cun, Pu Yen Hsiang, Chang Hua Hsien (TW)

( * ) Notice: Subject to any disclaimer, the term of this patent is extended or adjusted under 35 U.S.C. 154(b) by 1024 days.

(21) Appl. No.: 11/708,520

(22) Filed: Feb. 20, 2007

(51) Int. Cl.
*A61H 11/00* (2006.01)

(52) U.S. Cl. ..... 601/144; 601/146; 601/147

(58) Field of Classification Search ..... 601/23, 601/24, 26, 71, 124, 134, 136, 143, 144, 601/145, 146, 147; 482/51
See application file for complete search history.

(56) References Cited

U.S. PATENT DOCUMENTS 3,381,538 A * 5/1968 Runde ..... 601/146
4,991,568 A * 2/1991 Lin ..... 601/101
2004/0260216 A1* 12/2004 Zicherman ..... 601/144
2006/0009720 A1* 1/2006 Chung ..... 601/143

* cited by examiner

*Primary Examiner*—Quang D Thanh
(74) *Attorney, Agent, or Firm*—Alan Kamrath; Kamrath & Associates PA

(57) ABSTRACT

A belt exercising and massaging device includes a cushion, and a massaging belt unit mounted on the cushion and including two massaging belts each extending from a surface of the cushion and each movable relative to the cushion. Thus, the massaging belt unit is operated to drive the massaging belts to move and swing rightward and leftward so as to provide a massaging effect to a user. In addition, the massaging belts surround the user's body in a planar manner so that the force applied by the massaging belts is distributed on the user's body smoothly and evenly without producing an excessive vibration and a stress concentration, thereby providing a comfortable sensation to the user, and thereby preventing the user's body from being hurt.

17 Claims, 15 Drawing Sheets

BELT EXERCISING AND MASSAGING DEVICE

BACKGROUND OF THE INVENTION

1. Field of the Invention

The present invention relates to an exercising and massaging device and, more particularly, to a belt exercising and massaging device.

2. Description of the Related Art

A conventional massaging chair is used to massage a user's back to release the user's back muscles so as to provide a comfortable sensation to the user. However, the massaging chair cannot be used to massage other portions of the user's body, thereby limiting the versatility of the massaging chair.

A conventional belt exercising and massaging device comprises a belt mounted on a user's waist, and at least one vibrator mounted on the belt to provide a vibration to the belt. Thus, the belt is driven by the vibrator to provide a vibration to the user's waist so as to exercise the user's waist. However, the vibration force applied by the vibrator is not distributed on the user's waist evenly and smoothly, so that the user easily feels uncomfortable, and the user's waist is easily hurt.

BRIEF SUMMARY OF THE INVENTION

In accordance with the present invention, there is provided a belt exercising and massaging device, comprising a cushion, and a massaging belt unit mounted on the cushion and including two massaging belts each extending from a surface of the cushion and each movable relative to the cushion.

The primary objective of the present invention is to provide a belt exercising and massaging device, wherein the massaging belt unit is operated to drive the massaging belts to move and swing rightward and leftward so as to provide a massaging and exercising effect to a user.

Another objective of the present invention is to provide a belt exercising and massaging device, wherein the massaging belts surround the user's body in a planar manner so that the force applied by the massaging belts is distributed on the user's body smoothly and evenly without producing an excessive vibration and a stress concentration, thereby providing a comfortable sensation to the user, and thereby preventing the user's body from being hurt.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
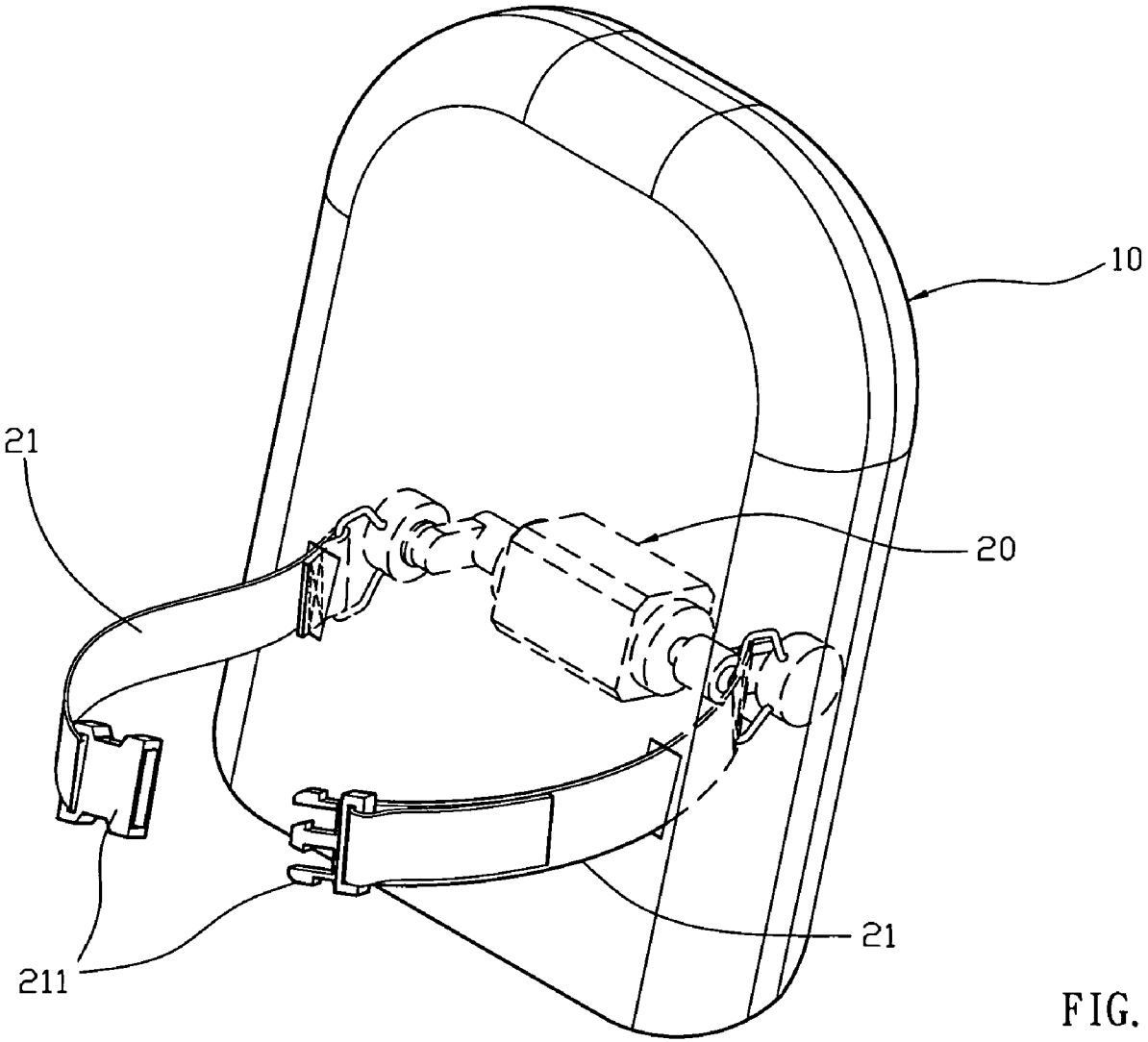
FIG. 1 is a perspective view of a belt exercising and massaging device in accordance with the preferred embodiment of the present invention.

Referring to the drawings and initially to FIGS. 1-5, a belt exercising and massaging device in accordance with the preferred embodiment of the present invention comprises a cushion 10, and a massaging belt unit 20 mounted on the cushion 10 and including two massaging belts 21 each extending from a surface of the cushion 10 and each movable relative to the cushion 10.

The cushion 10 is provided with a mounting seat 11 for mounting the massaging belt unit 20.

Figure 3:
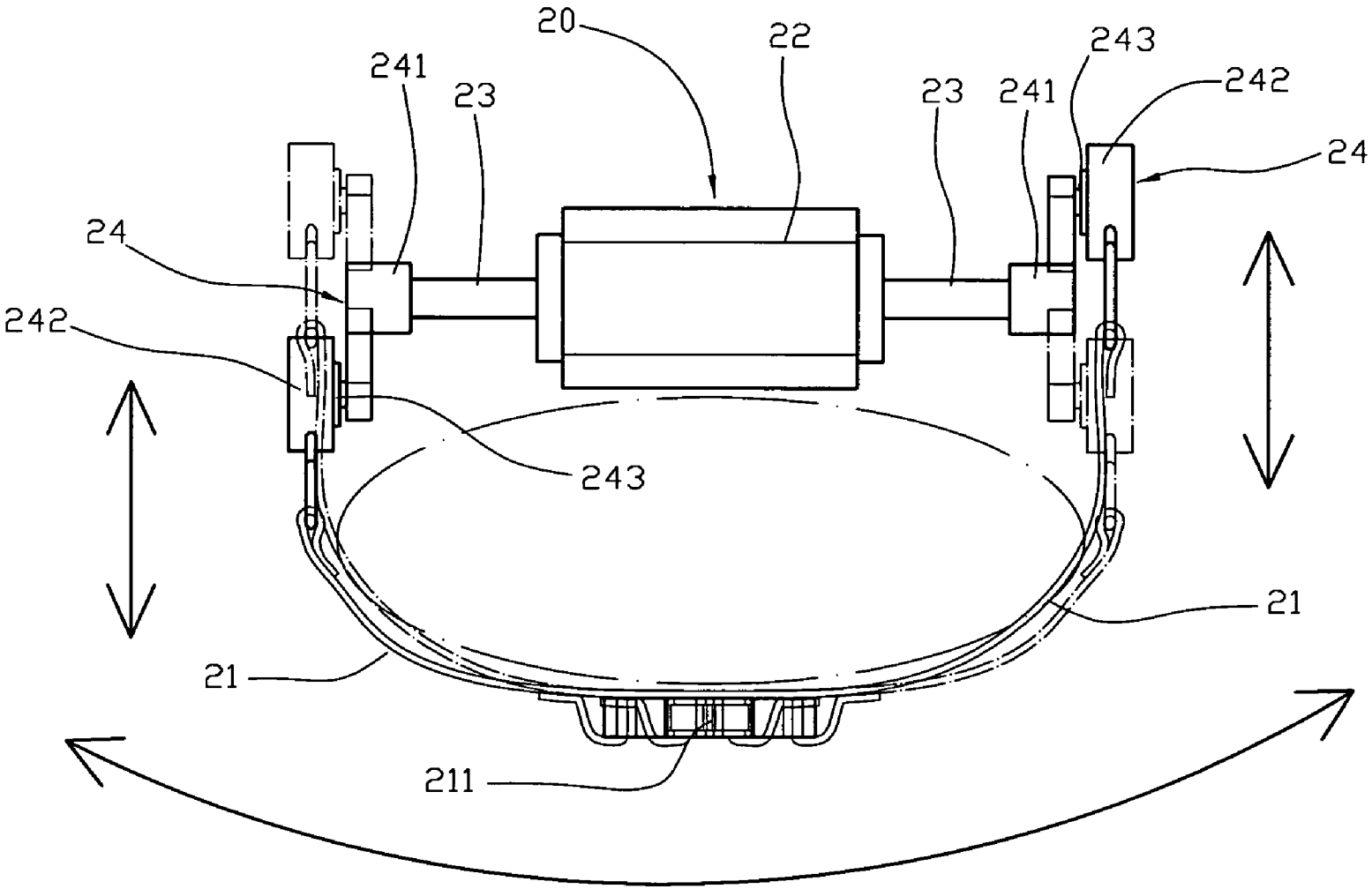
FIG. 3 is a top operational view of the belt exercising and massaging device as shown in FIG. 2.

The massaging belt unit 20 further includes a motor 22 mounted on the mounting seat 11 of the cushion 10, two opposite rotation shafts 23 each rotated by the motor 22, and two opposite eccentric mechanisms 24 each mounted between a respective rotation shaft 23 and a respective massaging belt 21 to move the respective massaging belt 21 reciprocally by rotation of the respective rotation shaft 23. The motor 22 of the massaging belt unit 20 is a dual-directional motor to rotate the two rotation shafts 23 which are located at two opposite ends of the motor 22. Each of the eccentric mechanisms 24 of the massaging belt unit 20 includes an eccentric member 241 secured on the respective rotation shaft 23 to rotate with the respective rotation shaft 23 reciprocally, and a rotation wheel 242 rotatably mounted on the eccentric member 241 by a bearing 243 to move with the eccentric member 241. The eccentric members 241 of the eccentric mechanisms 24 are directed toward two opposite directions as shown in FIG. 3. The rotation wheel 242 of each of the eccentric mechanisms 24 is rotatable about the eccentric member 241 simultaneously when the rotation wheel 242 is movable reciprocally with the eccentric member 241.

The massaging belts 21 of the massaging belt unit 20 are movable relative to the cushion 10 in two different directions. Each of the massaging belts 21 of the massaging belt unit 20 has a first end secured to the rotation wheel 242 of a respective eccentric mechanism 24 to move with the rotation wheel 242 and a second end provided with an adjustment bonding section 211. The adjustment bonding sections 211 of the massaging belts 21 are connected with each other to connect the massaging belts 21 together. In the preferred embodiment of the present invention, the adjustment bonding sections 211 of the massaging belts 21 include a male snap co-operating with a female snap.

Figure 2:
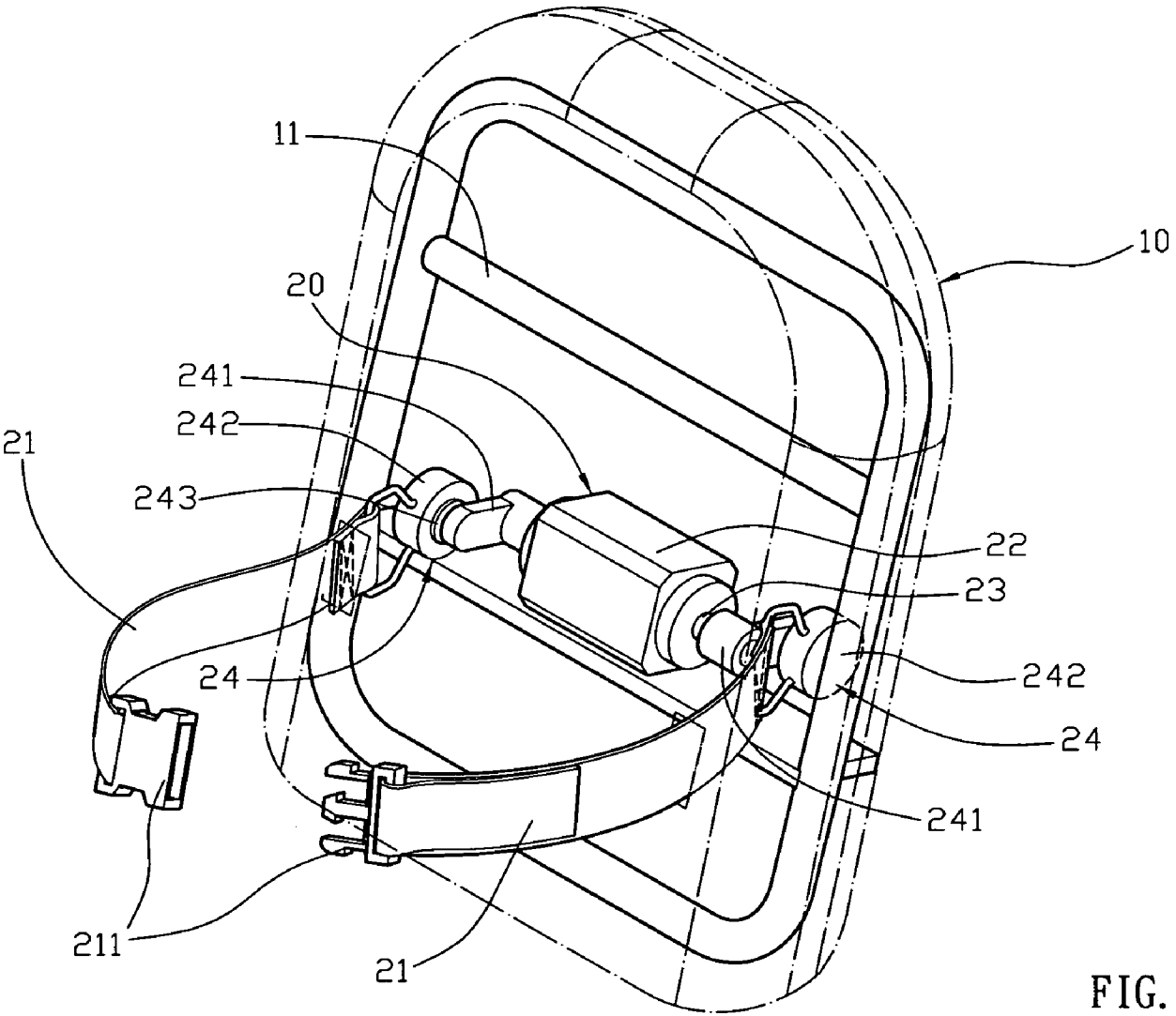
FIG. 2 is a partially cut-away perspective view of the belt exercising and massaging device as shown in FIG. 1.

In operation, referring to FIG. 3 with reference to FIGS. 1 and 2, when the motor 22 is operated, the two opposite rotation shafts 23 are rotated by the motor 22 to rotate the eccentric member 241 of each of the eccentric mechanisms 24 eccentrically, so that the rotation wheel 242 of each of the eccentric mechanisms 24 is moved with the eccentric member 241 reciprocally and rotated about the eccentric member 241 to move the respective massaging belt 21 forward and backward. At this time, the eccentric members 241 of the eccentric mechanisms 24 are directed toward two opposite directions, and the massaging belts 21 are connected by the adjustment bonding sections 211, so that the massaging belts 21 are driven by the eccentric members 241 of the eccentric mechanisms 24 to move and swing rightward and leftward so as to provide a massaging effect to a user.

Figure 4:
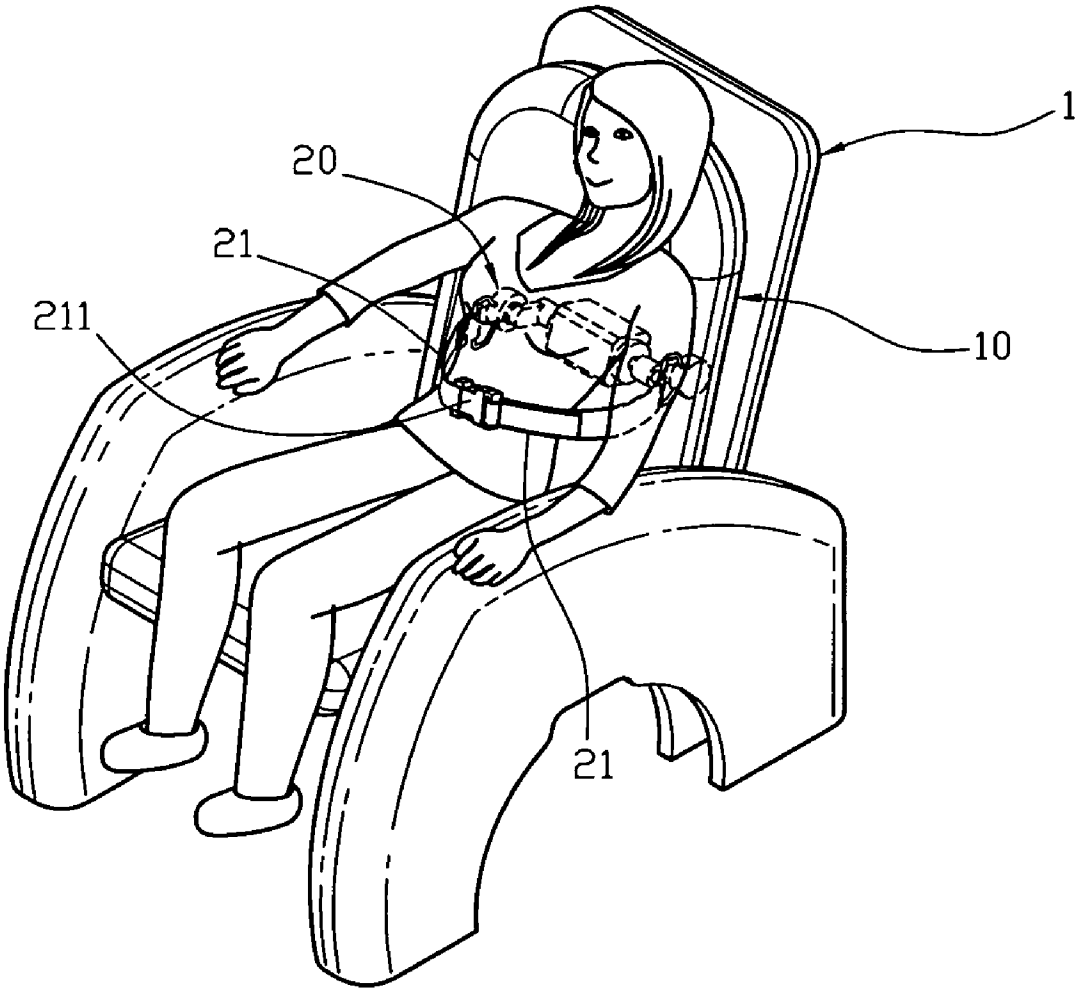
FIG. 4 is a perspective view showing usage of the belt exercising and massaging device as shown in FIG. 1.

As shown in FIGS. 2 and 4, the cushion 10 is minted on a chair 1, and the massaging belts 21 are connected to surround a user's waist. Thus, the massaging belts 21 are driven by the eccentric members 241 of the eccentric mechanisms 24 to move and swing rightward and leftward so as to provide a massaging effect to the user's waist.

Figure 5:
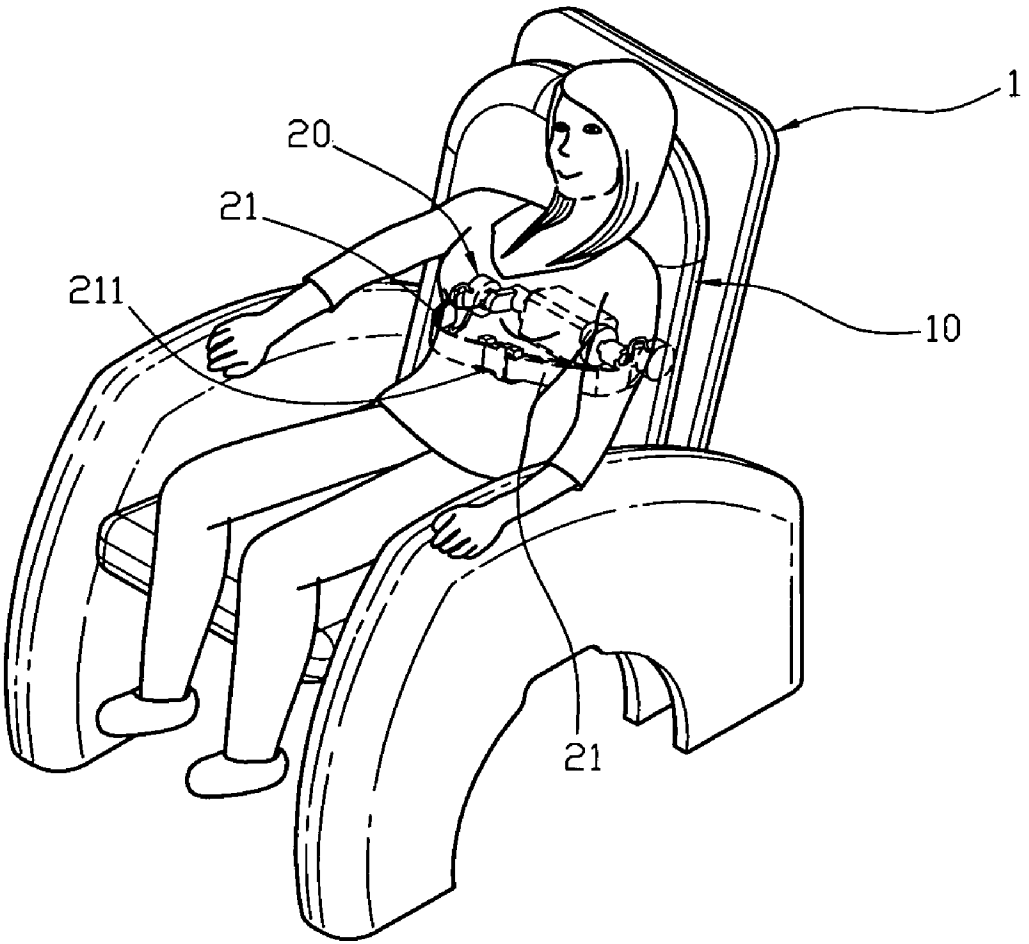
FIG. 5 is a perspective view showing usage of the belt exercising and massaging device as shown in FIG. 1.

As shown in FIGS. 2 and 5, the cushion 10 is mounted on a chair 1, and the massaging belts 21 are connected to rest on a user's back. Thus, the massaging belts 21 are driven by the eccentric members 241 of the eccentric mechanisms 24 to move and swing rightward and leftward so as to provide a massaging effect to the user's back.

Figure 6:
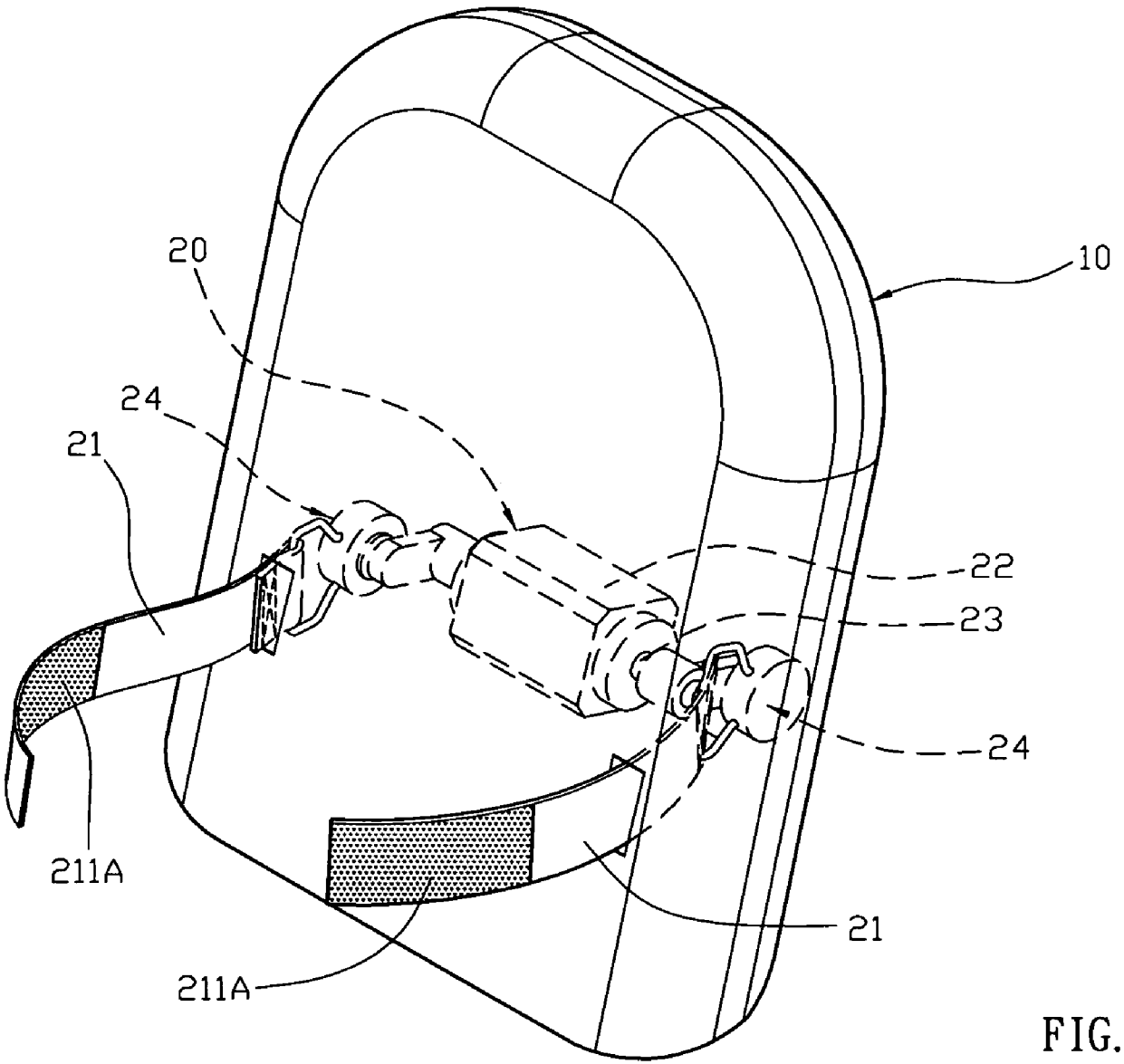
FIG. 6 is a perspective view of a belt exercising and massaging device in accordance with another preferred embodiment of the present invention.
Figure 7:
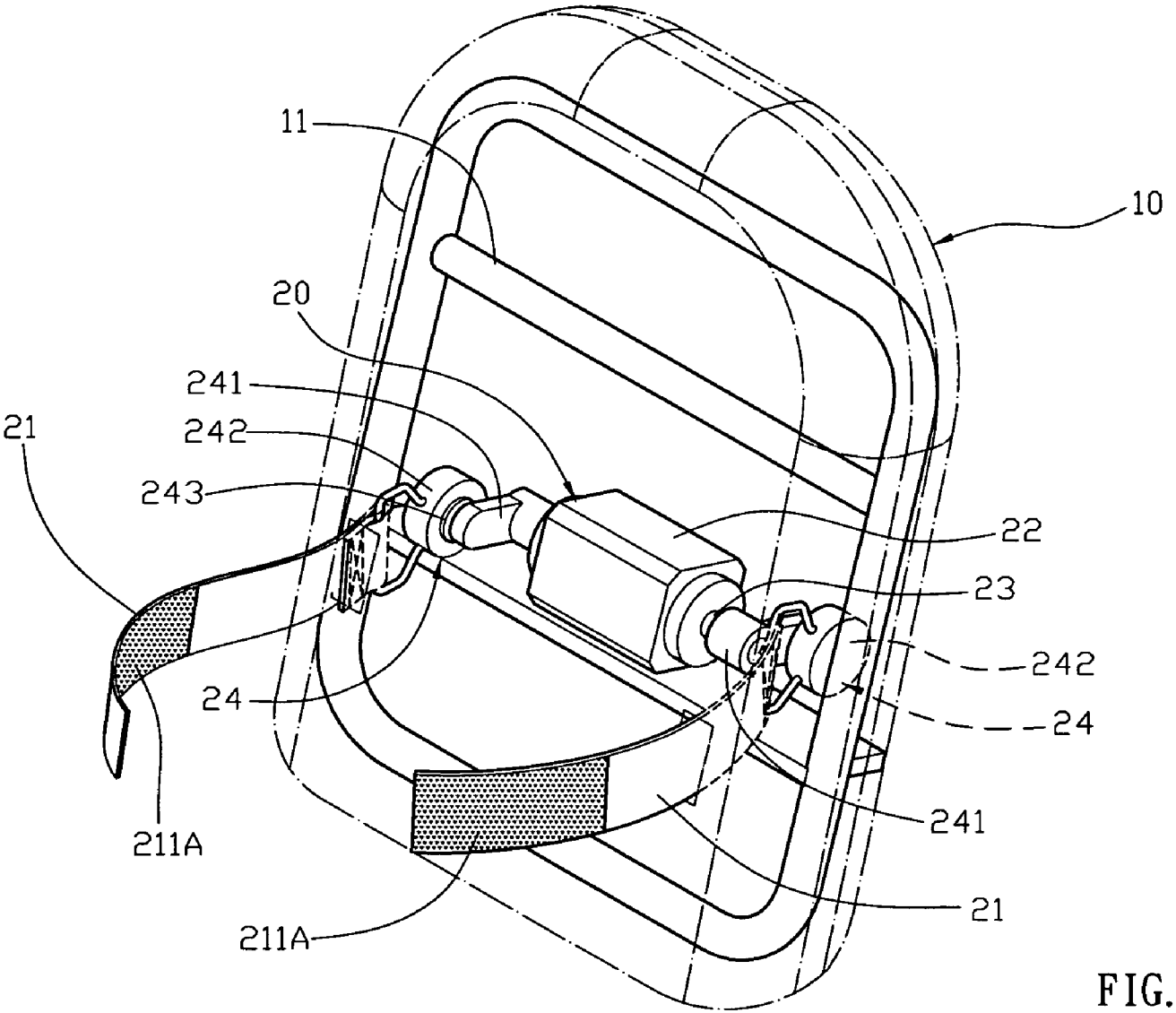
FIG. 7 is a partially cut-away perspective view of the belt exercising and massaging device as shown in FIG. 6.
Figure 8:
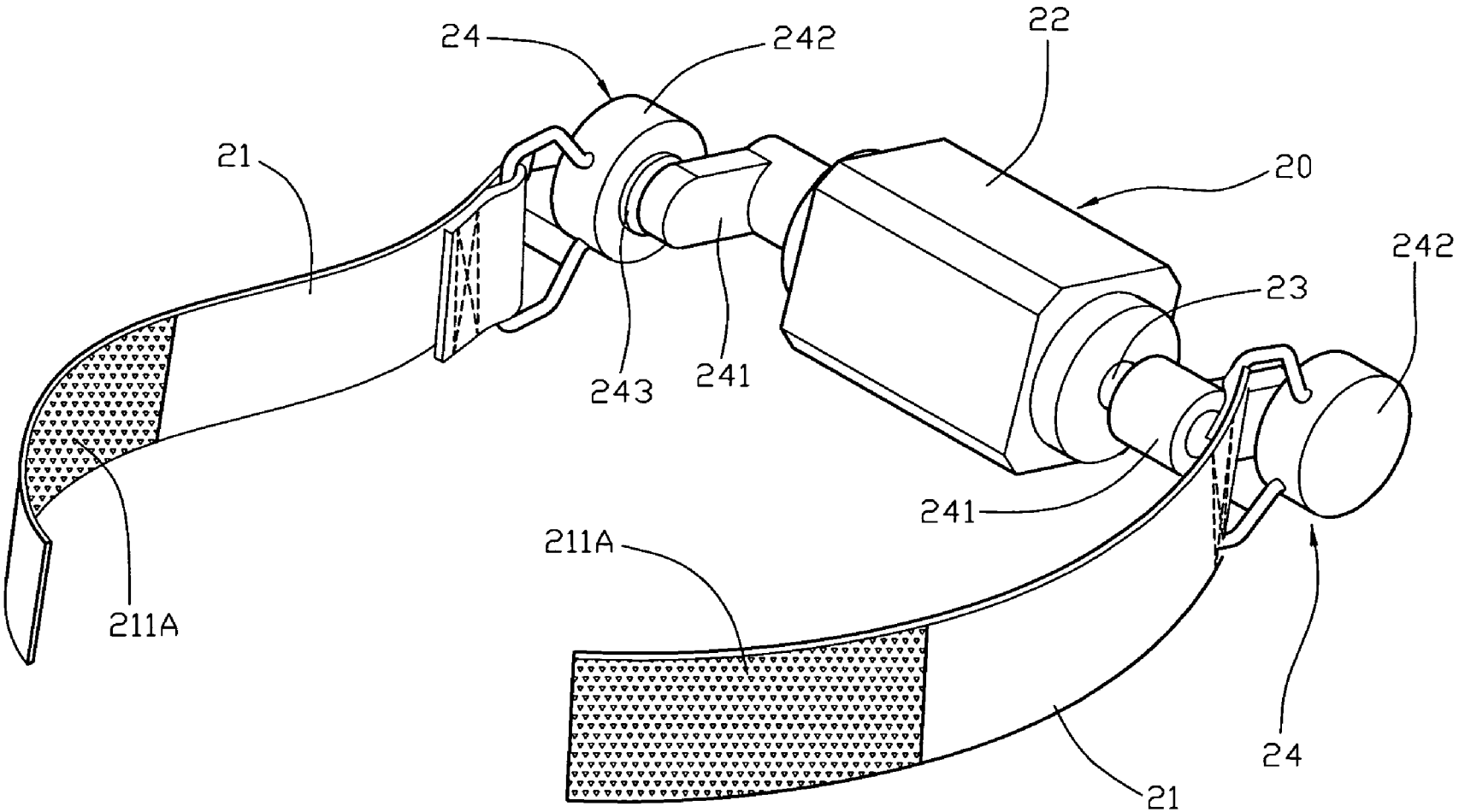
FIG. 8 is a locally enlarged view of the belt exercising and massaging device as shown in FIG. 7.

Referring to FIGS. 6-8, the adjustment bonding section 211A of each of the massaging belts 21 is a bonding strap.

As shown in FIGS. 1-8, the cushion 10 functions as a backrest cushion.

Figure 9:
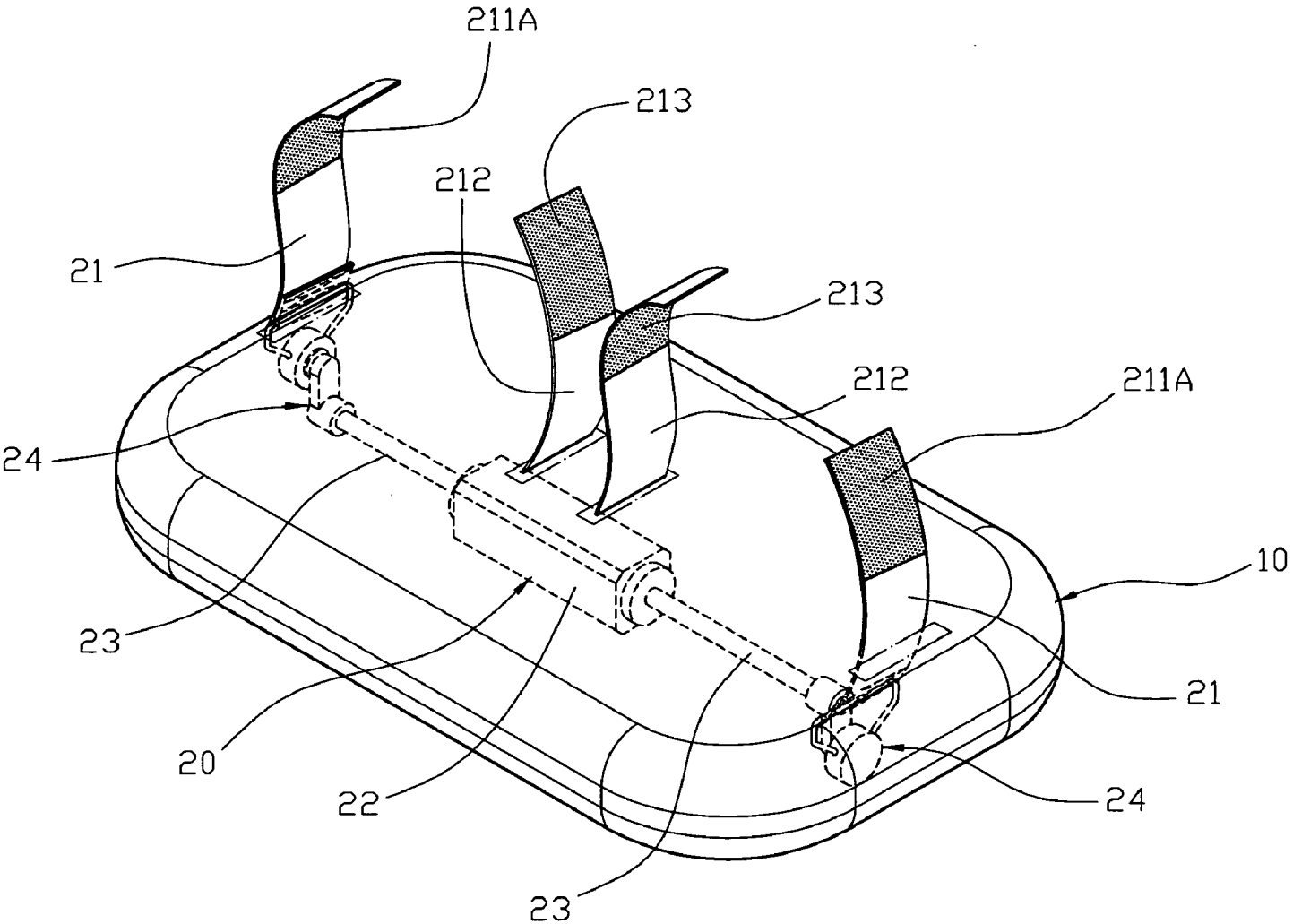
FIG. 9 is a perspective view of a belt exercising and massaging device in accordance with another preferred embodiment of the present invention.
Figure 10:
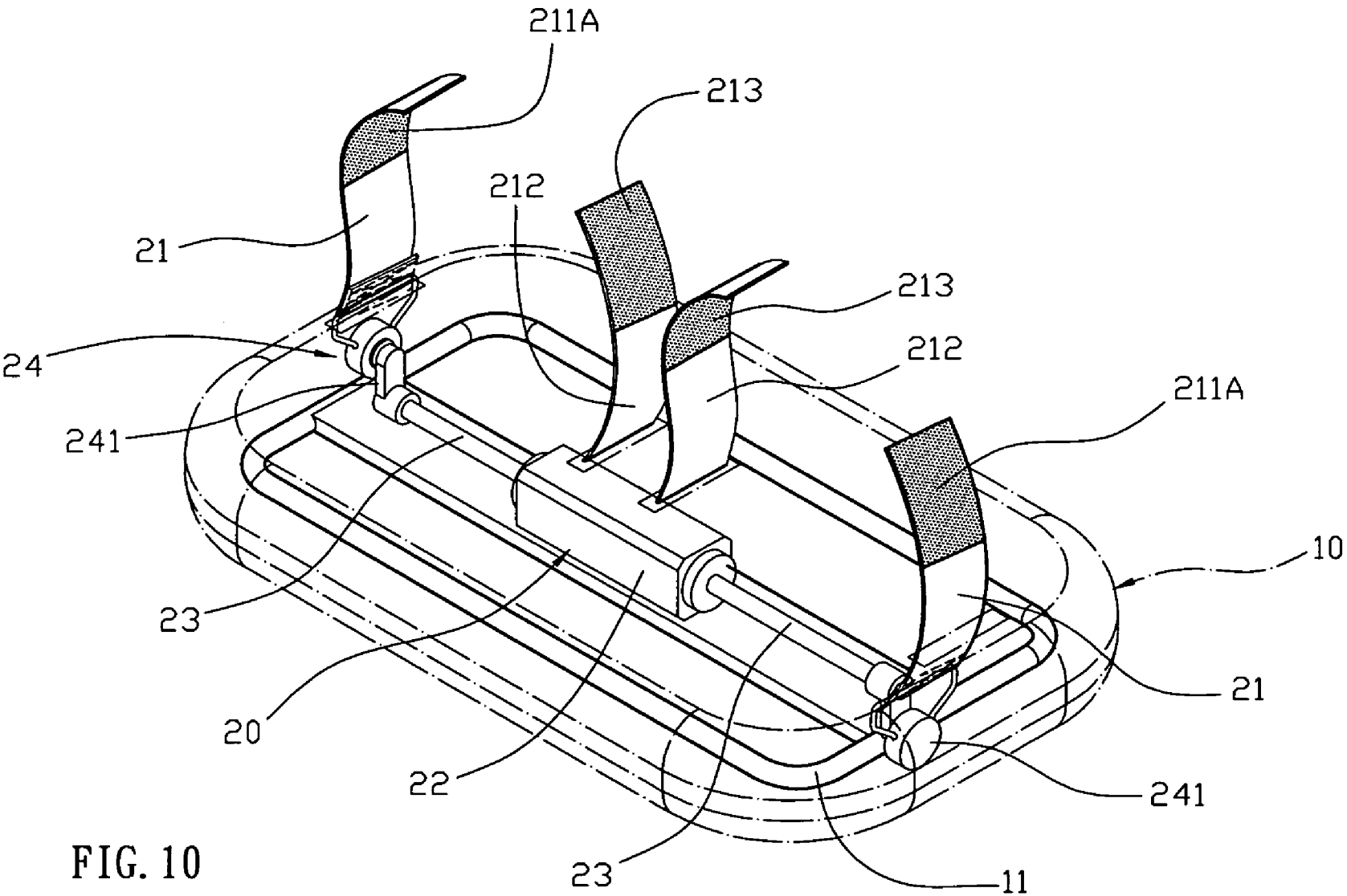
FIG. 10 is a partially cut-away perspective view of the belt exercising and massaging device as shown in FIG. 9.

Referring to FIGS. 9 and 10, the massaging belt unit 20 further includes two fixing belts 212 located between the massaging belts 21 and each connected with a respective massaging belt 21. Each of the fixing belts 212 has a first end secured to the cushion 10 and a second end provided with an adjustment bonding portion 213 bonded onto the adjustment bonding section 211A of the respective massaging belt 21 to connect each of the fixing belts 212 with the respective massaging belt 21 together.

As shown in FIGS. 9 and 10, the cushion 10 functions as a seat cushion.

Figure 11:
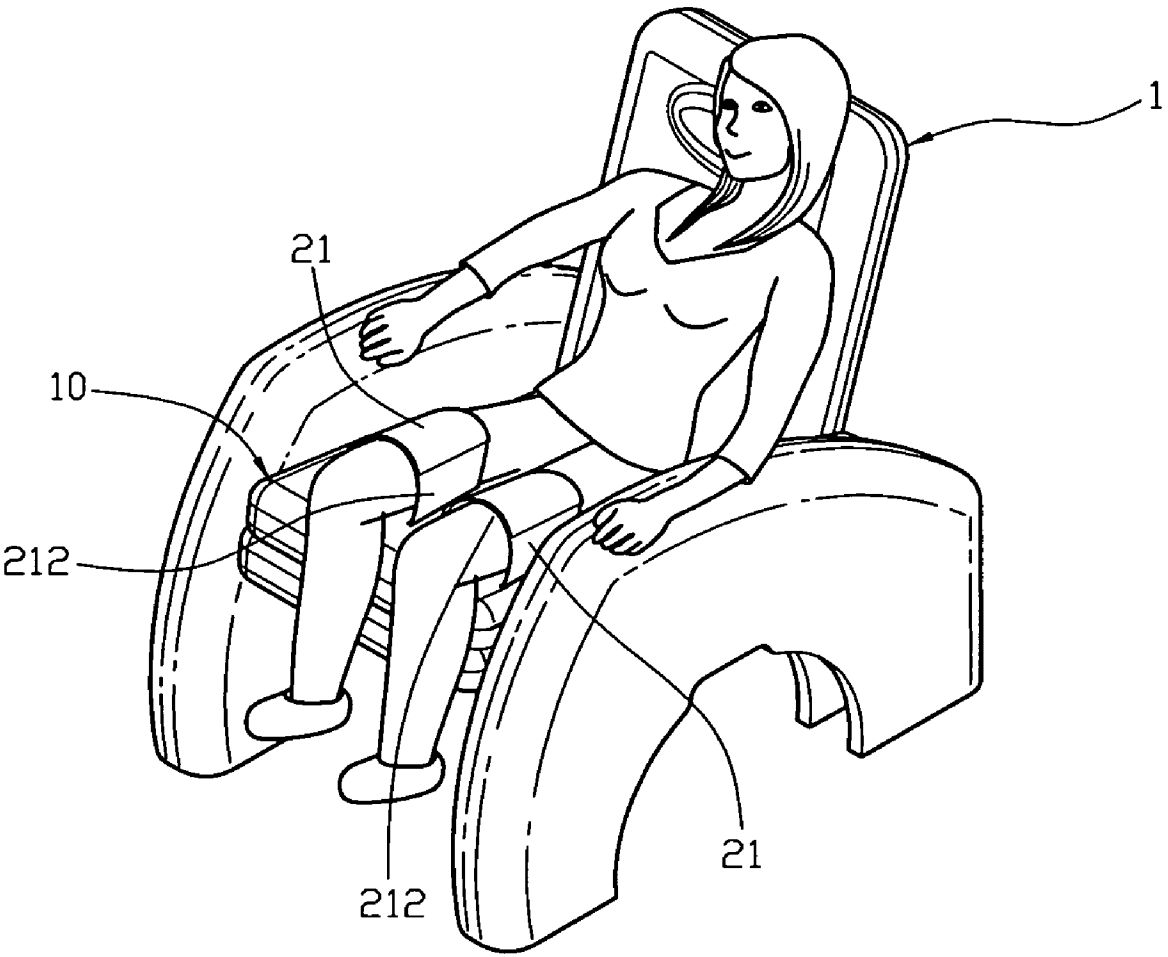
FIG. 11 is a perspective view showing usage of the belt exercising and massaging device as shown in FIG. 9.

As shown in FIGS. 10 and 11, the cushion 10 is mounted on a chair 1, and each of the fixing belts 212 is connected with the respective massaging belt 21 to surround a user's leg. Thus, the massaging belts 21 are driven by the eccentric members 241 of the eccentric mechanisms 24 to move and swing rightward and leftward so as to provide a massaging effect to the user's legs.

Figure 12:
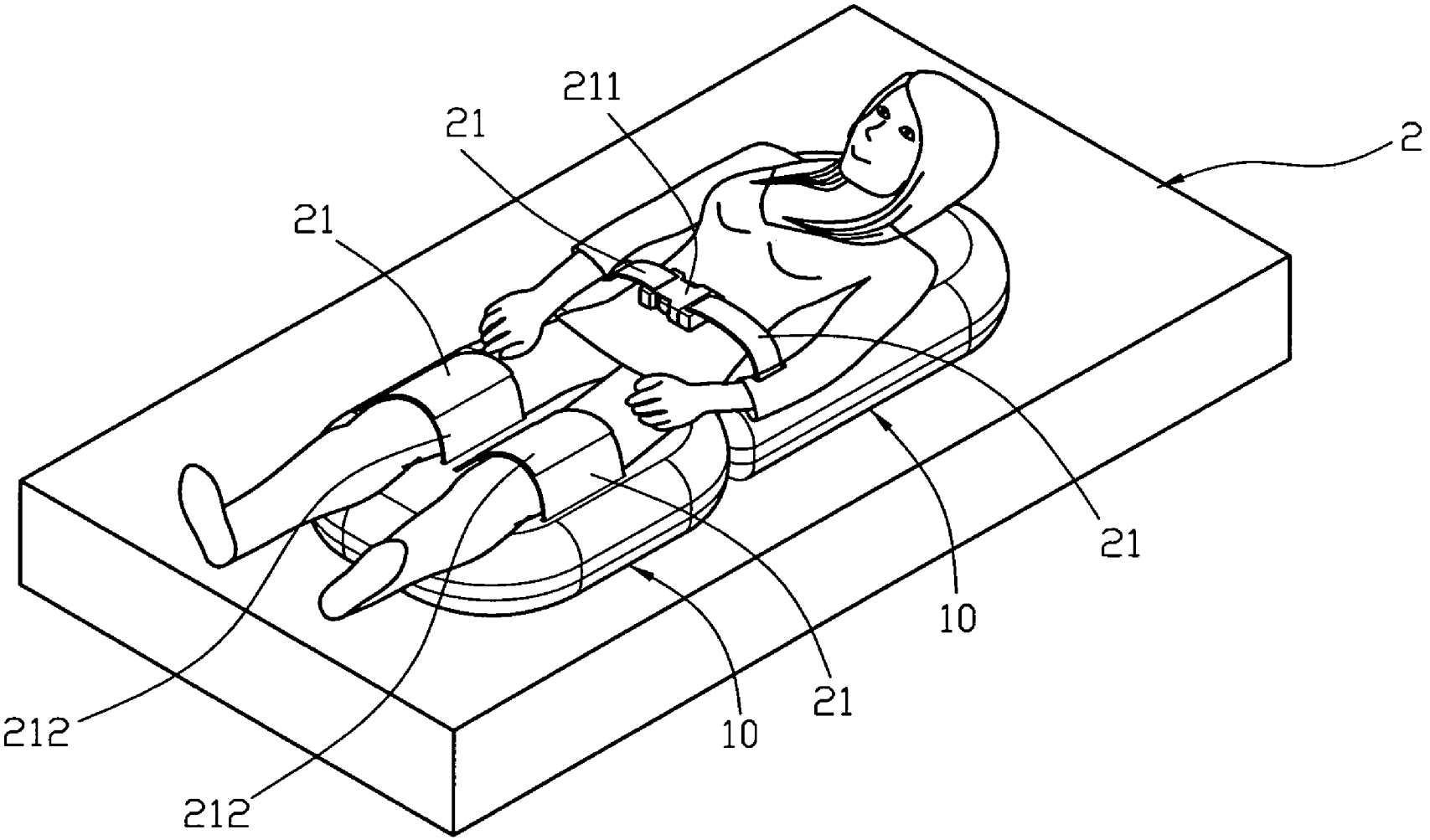
FIG. 12 is a perspective view showing usage of the belt exercising and massaging device as shown in FIGS. 1 and 9.

As shown in FIG. 12, two cushions 10 are mounted on a bed 2, the massaging belts 21 are connected to surround a user's waist, and each of the fixing belts 212 is connected with the respective massaging belt 21 to surround the user's leg.

Figure 13:
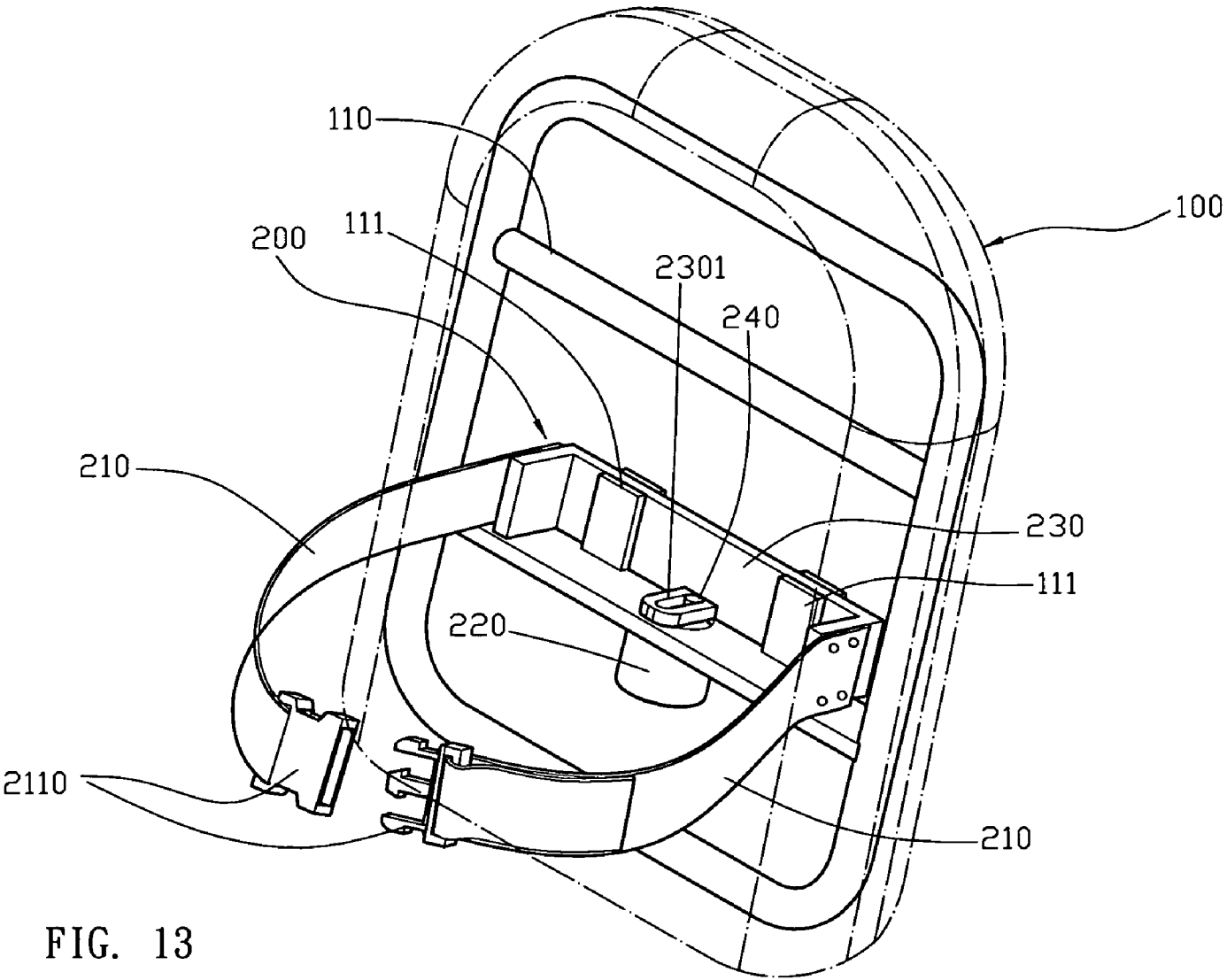
FIG. 13 is a perspective view of a belt exercising and massaging device in accordance with another preferred embodiment of the present invention.
Figure 14:
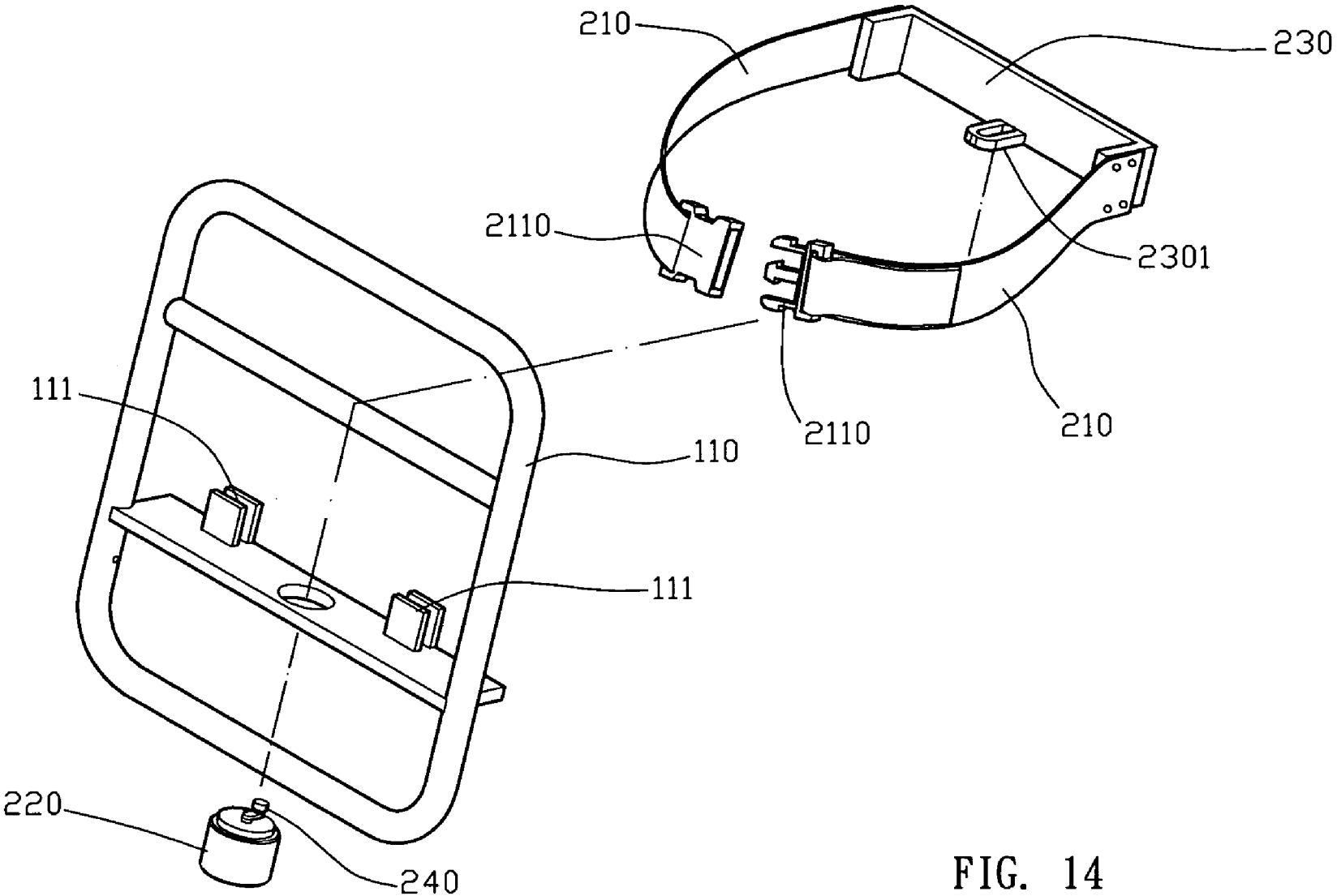
FIG. 14 is a partially exploded perspective view of the belt exercising and massaging device as shown in FIG. 13.
Figure 15:
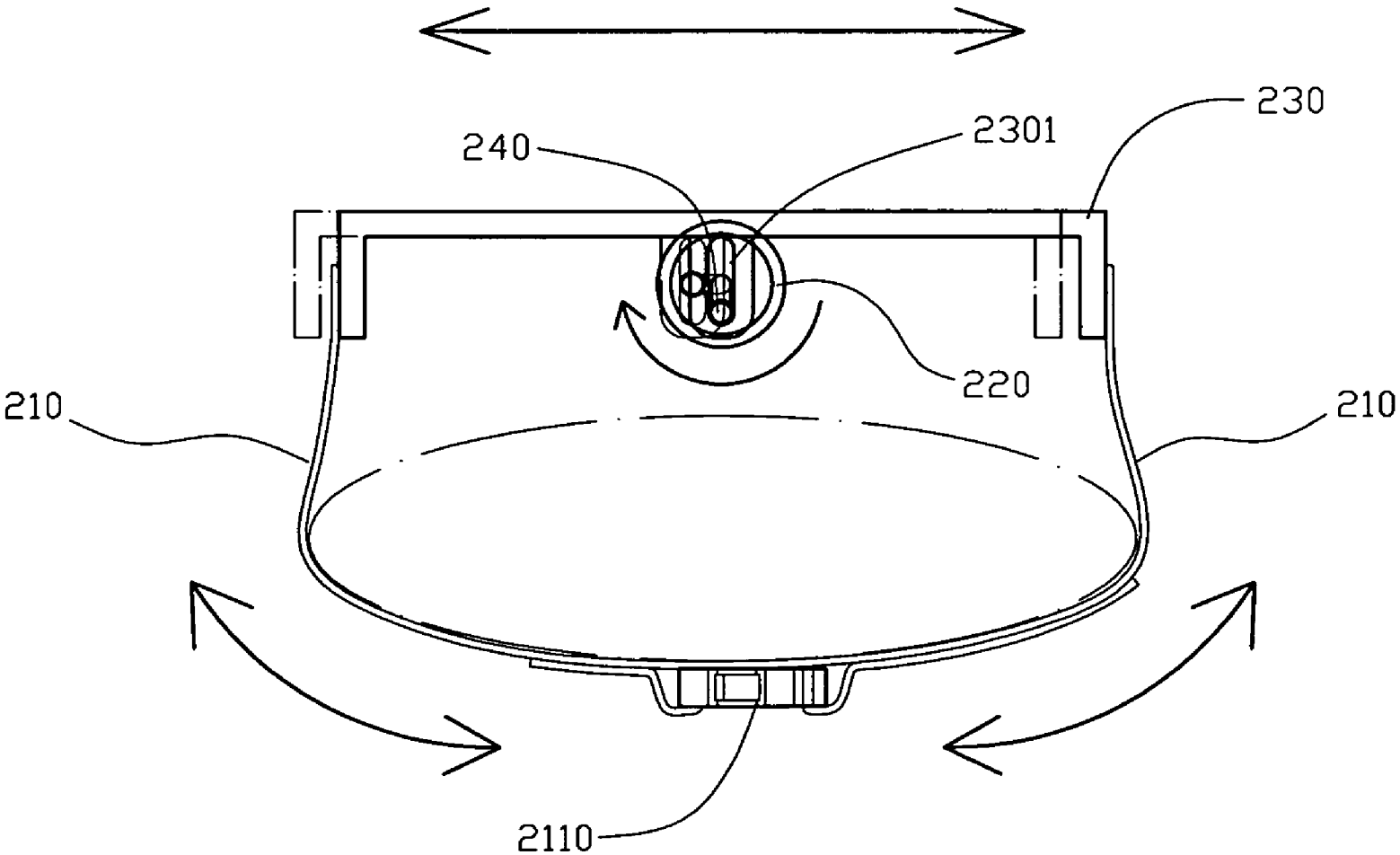
FIG. 15 is a top operational view of the belt exercising and massaging device as shown in FIG. 13.

Referring to FIGS. 13-15, the massaging belt unit 200 further includes a motor 220 mounted on the mounting seat 110 of the cushion 100, a movable shaft 230 movably mounted on the mounting seat 110 of the cushion 100 and connected to the massaging belts 210 to move the massaging belts 210 reciprocally, and an eccentric mechanism 240 rotated by the motor 220 and connected to the movable shaft 230 to move the movable shaft 230 reciprocally relative to the mounting seat 110 of the cushion 100.

The mounting seat 110 of the cushion 100 is formed with at least one slideway 111 in which the movable shaft 230 is slidable rightward and leftward. The movable shaft 230 of the massaging belt unit 200 is formed with a guide slot 2301, and the eccentric mechanism 240 is rotatably mounted on the motor 220 eccentrically and rotatable and movable in the guide slot 2301 of the movable shaft 230.

Each of the massaging belts 210 of the massaging belt unit 200 has a first end secured to one of two opposite ends of the movable shaft 230 to move with the movable shaft 230 and a second end provided with an adjustment bonding section 2110. The adjustment bonding sections 2110 of the massaging belts 210 are connected with each other to connect the massaging belts 210 together. In the preferred embodiment of the present invention, the adjustment bonding sections 2110 of the massaging belts 210 include a male snap co-operating with a female snap.

Accordingly, the massaging belt unit is operated to drive the massaging belts to move and swing rightward and leftward so as to provide a massaging and exercising effect to a user. In addition, the massaging belts surround the user's body in a planar manner so that the force applied by the massaging belts is distributed on the user's body smoothly and evenly without producing an excessive vibration and a stress concentration, thereby providing a comfortable sensation to the user, and thereby preventing the user's body from being hurt.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A belt exercising and massaging device, comprising:

a cushion;

a massaging belt unit mounted on the cushion and including two massaging belts each extending from a surface of the cushion and each movable relative to the cushion;

wherein the cushion is provided with a mounting seat for mounting the massaging belt unit;

the massaging belt unit further includes a motor mounted on the mounting seat of the cushion, two opposite rotation shafts each rotated by the motor, and two opposite eccentric mechanisms each mounted between a respective rotation shaft and a respective massaging belt to move the respective massaging belt reciprocally by rotation of the respective rotation shaft;

each of the eccentric mechanisms of the massaging belt unit includes an eccentric member secured on the respective rotation shaft to rotate with the respective rotation shaft reciprocally, mounted on the eccentric member to move with the eccentric member.

2. The belt exercising and massaging device in accordance with claim 1, wherein the motor of the massaging belt unit is a dual-directional motor to rotate the two rotation shafts.

3. The belt exercising and massaging device in accordance with claim 1, wherein the rotation shafts are located at two opposite ends of the motor.

4. The belt exercising and massaging device in accordance with claim 1, wherein the rotation wheel of each of the eccentric mechanisms is rotatably mounted on the eccentric member by a bearing.

5. The belt exercising and massaging device in accordance with claim 1, wherein the eccentric members of the eccentric mechanisms are directed toward two opposite directions.

6. The belt exercising and massaging device in accordance with claim 1, wherein the rotation wheel of each of the eccentric mechanisms is rotatable about the eccentric member simultaneously when the rotation wheel is movable reciprocally with the eccentric member.

7. The belt exercising and massaging device in accordance with claim 1 wherein each of the massaging belts of the massaging belt unit has a first end secured to the rotation wheel of a respective eccentric mechanism to move with the rotation wheel and a second end provided with an adjustment bonding section, and the adjustment bonding sections of the massaging belts are connected with each other to connect the massaging belts together.

8. The belt exercising and massaging device in accordance with claim 7, wherein the massaging belts of the massaging belt unit are movable relative to the cushion in two different directions.

9. The belt exercising and massaging device in accordance with claim 7, wherein the adjustment bonding sections of the massaging belts include a male snap co-operating with a female snap.

10. The belt exercising and massaging device in accordance with claim 7, wherein the adjustment bonding section of each of the massaging belts is a bonding strap.

11. The belt exercising and massaging device in accordance with claim 7, wherein the massaging belts are driven by the eccentric members of the eccentric mechanisms to move and swing rightward and leftward.

12. The belt exercising and massaging device in accordance with claim 7, wherein the massaging belt unit further includes two fixing belts located between the massaging belts and each connected with a respective massaging belt, and each of the fixing belts has a first end secured to the cushion and a second end provided with an adjustment bonding portion bonded onto the adjustment bonding section of the respective massaging belt to connect each of the fixing belts with the respective massaging belt together.

13. The belt exercising and massaging device in accordance with claim 1, wherein the cushion functions as a backrest cushion or a seat cushion.

14. A belt exercising and massaging device, comprising:

a cushion;

a massaging belt unit mounted on the cushion and including two massaging belts each extending from a surface of the cushion and each movable relative to the cushion;

wherein the cushion is provided with a mounting seat for mounting the massaging belt unit;

the massaging belt unit further includes a motor mounted on the mounting seat of the cushion, a movable shaft movably mounted on the mounting seat of the cushion and connected to the massaging belts to move the massaging belts reciprocally, and an eccentric mechanism rotated by the motor and connected to the movable shaft to move the movable shaft reciprocally relative to the mounting seat of the cushion.

15. The belt exercising and massaging device in accordance with claim 14, wherein the mounting seat of the cushion is formed with at least one slideway in which the movable shaft is slidable rightward and leftward.

16. The belt exercising and massaging device in accordance with claim 14, wherein the movable shaft of the massaging belt unit is formed with a guide slot, and the eccentric mechanism is rotatable and movable in the guide slot of the movable shaft, and is rotatably mounted on the motor eccentrically.

17. The belt exercising and massaging device in accordance with claim 14, wherein each of the massaging belts of the massaging belt unit has a first end secured to one of two opposite ends of the movable shaft to move with the movable shaft and a second end provided with an adjustment bonding section, and the adjustment bonding sections of the massaging belts are connected with each other to connect the massaging belts together.

* * * * *